US009848663B2

(12) United States Patent
Dunn et al.

(10) Patent No.: US 9,848,663 B2
(45) Date of Patent: Dec. 26, 2017

(54) CAP HAVING STRIKER SURFACE

(71) Applicants: Steven Bryan Dunn, Beverly Hills, CA (US); Brittany Beaudette Dunn, Beverly Hills, CA (US); Steven Winston Dunn, Beverly Hills, CA (US)

(72) Inventors: Steven Bryan Dunn, Beverly Hills, CA (US); Brittany Beaudette Dunn, Beverly Hills, CA (US); Steven Winston Dunn, Beverly Hills, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

(21) Appl. No.: 14/029,275

(22) Filed: Sep. 17, 2013

(65) Prior Publication Data

US 2015/0074870 A1 Mar. 19, 2015

(51) Int. Cl.

| | |
|---|---|
| ***A42B 1/24*** | (2006.01) |
| ***A24F 29/00*** | (2006.01) |
| ***A42B 1/06*** | (2006.01) |

(52) U.S. Cl.

CPC ..... *A42B 1/241* (2013.01); *A24F 29/00* (2013.01); *A42B 1/06* (2013.01); *A42B 1/062* (2013.01)

(58) Field of Classification Search

CPC ..... A42B 1/004; A42B 1/242; A42B 1/241; A42B 1/24; A42B 1/248

USPC ..... 2/209.13, 195.1

See application file for complete search history.

(56) References Cited

U.S. PATENT DOCUMENTS

| | | | | |
|---|---|---|---|---|
| 40,382 | A * | 10/1863 | Lambert | 2/209.13 |
| 224,878 | A * | 2/1880 | Clark | 2/209.13 |
| 1,418,217 | A * | 5/1922 | Warner | 206/101 |
| 1,443,744 | A * | 1/1923 | Hizer | 206/101 |
| 1,504,099 | A | 8/1924 | Christensen | |
| 1,509,309 | A | 9/1924 | Otto et al. | |
| 1,664,255 | A * | 3/1928 | Lesser | 2/195.5 |
| 1,723,276 | A * | 8/1929 | Gottlieb | 224/181 |
| 1,879,341 | A * | 9/1932 | Mortimer | 2/102 |
| 2,156,238 | A * | 4/1939 | Frankmann et al. | 2/181 |
| 2,716,753 | A * | 9/1955 | Gordon | 2/195.1 |
| 2,744,256 | A * | 5/1956 | Slotkin et al. | 2/209.13 |
| 3,766,565 | A * | 10/1973 | Cozzens | 2/209.7 |
| D439,728 | S * | 4/2001 | Smith | D2/876 |
| D488,292 | S * | 4/2004 | Haggberg | D2/866 |
| 7,487,554 | B1 | 2/2009 | Epstein et al. | |
| 8,051,497 | B1 | 11/2011 | Erhardt | |
| 8,813,268 | B1 * | 8/2014 | Fitzgerald et al. | 2/422 |
| 2003/0041367 | A1 * | 3/2003 | Hadden et al. | 2/195.5 |
| 2005/0050613 | A1 * | 3/2005 | Legg et al. | 2/209.13 |
| 2007/0130670 | A1 * | 6/2007 | Henf | 2/195.1 |
| 2009/0172866 | A1 * | 7/2009 | Chang | 2/209.12 |

(Continued)

OTHER PUBLICATIONS

"Crested China Top Hat Match Striker, Middlesbrough" http://www.tias.com/2816/PictPage/3924073135.html Jul. 18, 2013 (1 Page).

(Continued)

*Primary Examiner* — Clinton T Ostrup
*Assistant Examiner* — Bao-Thieu L Nguyen
(74) *Attorney, Agent, or Firm* — Robert Z. Evora, Esq.; Christian Lek

(57) ABSTRACT

A hat assembly and method of use is provided including a striking surface for igniting a flammable instrument. The hat assembly may also provide a receptacle for storing flammable instruments.

17 Claims, 20 Drawing Sheets

(56) References Cited

U.S. PATENT DOCUMENTS

| | | | | |
|---|---|---|---|---|
| 2011/0061145 | A1* | 3/2011 | Zuloff | 2/209.13 |
| 2014/0137441 | A1* | 5/2014 | Gudgel | 36/136 |
| 2014/0304891 | A1* | 10/2014 | Waters | 2/209.13 |

OTHER PUBLICATIONS

"What if . . . Matches Would Strike Easily?" http://clementeloy.com/post/50428609738/et-si-les-allumettes-sallumaient-facilement Jul. 25, 2013 (5 Pages).

* cited by examiner

CAP HAVING STRIKER SURFACE

TECHNICAL FIELD

The subject disclosure relates to a hat having an easy to reach striking surface and means for holding matches.

BACKGROUND

Matches are typically held in either matchbooks or boxes. Both usually have a match striking means, either a small, thin striking surface on an outer flap of a matchbook or a long striking surface on an outer face of a matchbox.

However, the problem many face with conventional matchbooks and matchboxes is that they are either difficult to use or to transport. While being small and easy to transport, matchbooks usually have a very small striking surface which is not convenient for most users. That is, the user must have more precision when aligning the match with the striking surface to cause ignition. In addition, the user must hold onto the matchbook with one hand while using their other hand to hold and strike the match itself. While the matchbook is small, it is not very convenient or easy to use.

The opposite problem is had with matchboxes. While having a large striking surface, matchboxes are typically too large to conveniently carry in a coat or pants pocket. Again, the user must hold the matchbox with one hand while striking the match with their other hand. Here, the matchbox is self contained but not portable or convenient to use.

Although various solutions have been proposed, none available have effectively solved this problem.

SUMMARY

The following presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

One or more embodiments of the subject disclosure provide for a hat assembly and method of use. The hat assembly provides a striking surface for igniting a flammable instrument. The hat assembly may also provide a receptacle for storing flammable instruments.

While various aspects, features, or advantages of the subject disclosure are illustrated in reference to hats, such aspects and features also can be exploited in various other forms of headgear or clothing.

To the accomplishment of the foregoing and related ends, the subject disclosure comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

DETAILED DESCRIPTION

Figure 1:
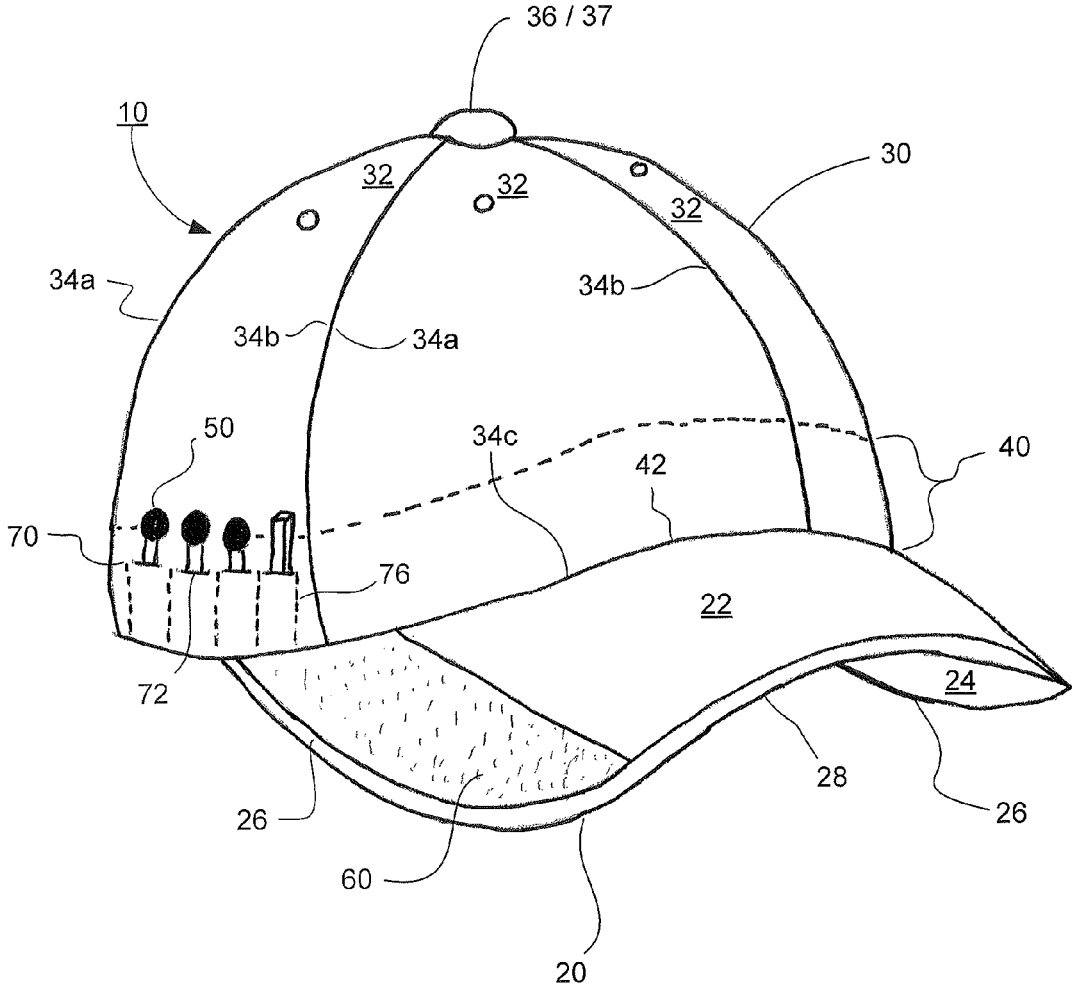
FIG. 1 is a front perspective of an exemplary hat assembly having a brim, crown, headband portion, striking surface and receptacle in accordance with aspects described herein.

The subject disclosure is described with references to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

FIG. 1 illustrates a hat assembly 10 having a brim 20, a crown 30, and a headband portion 40. The hat assembly 10 includes a striking surface 60 material and a receptacle 70.

The brim 20 is in the form of an outwardly projecting rim which includes a top surface 22, a bottom surface 24, side surfaces 26 and a front surface 28 extending contiguous with the side surfaces 26. The brim 20 is attached to a lower edge 42 of the headband portion 40. The brim 20 can take a variety of different shapes and may also be in the form of a complete annular rim, band, fringe, ridge, frame or other suitable configuration. The brim 20 can be made from a wide variety of materials, flat or curved, with various thicknesses. The hat assembly 10 may be worn facing any direction, but usually the brim 20 will point forward to shield the user's eyes from sunlight.

Figure 2:
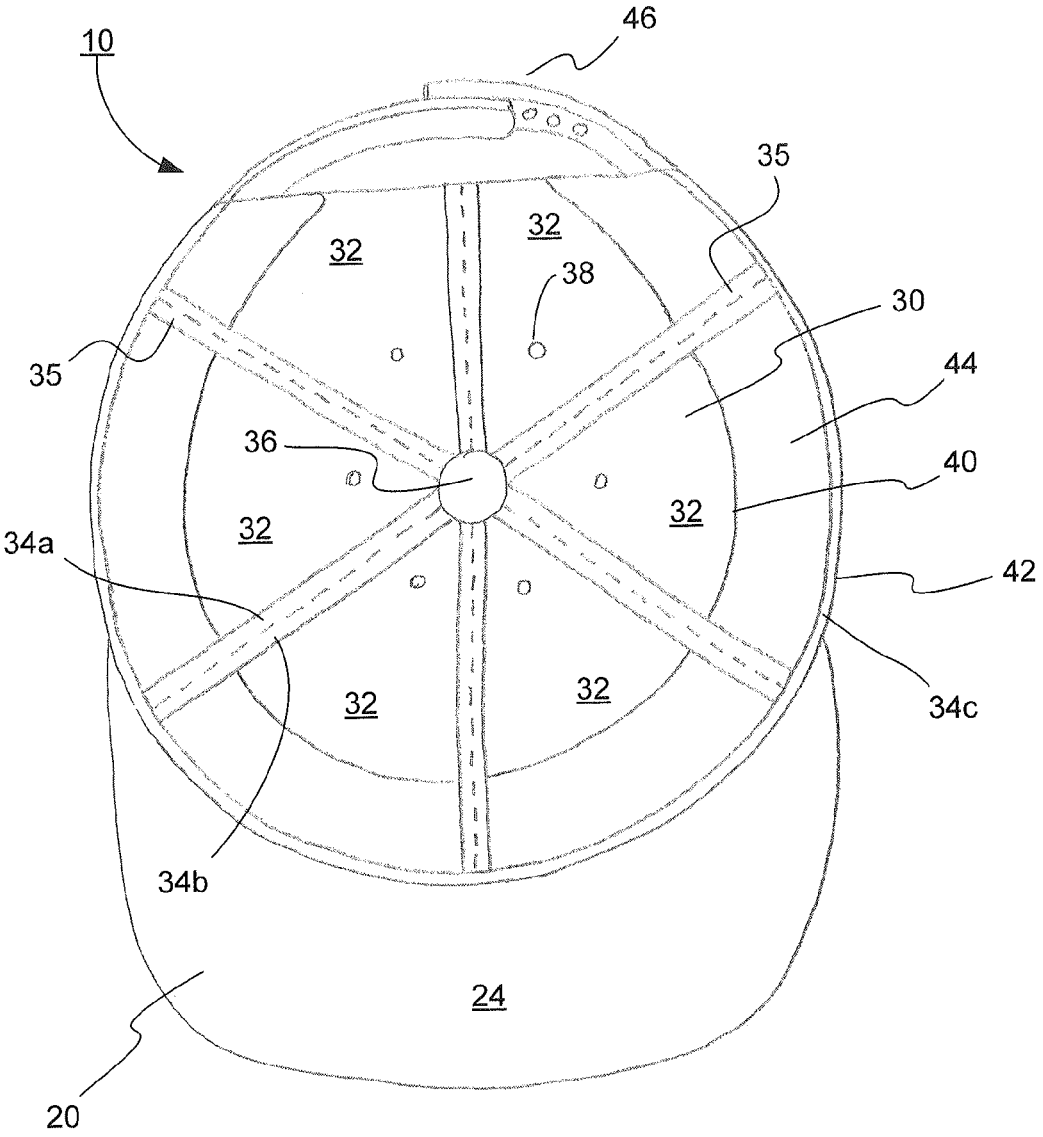
FIG. 2 shows a bottom view of the hat assembly.

FIGS. 1-2 depict the crown 30 formed by a plurality of triangular, concave shaped panels 32. When a first edge 34*a* of a first panel 32 adjoins a second edge 34*b* of another adjacent panel 32, the plurality of panels 32 concentrically placed adjacent to each other form together at an apex 36. An apex fastener 37 secures a top portion of each of the panels 32 to define an upper rounded portion of the crown 30. Lower third edges 34*c* of the panels 32 form the lower edge 42 of the headband portion 40.

A lining element 35 may be added over the adjoining first edge 34*a* and second edge 34*b* to further secure the two adjacent panels 32 together and cover the first edge 34*a* and second edge 34*b*. Each panel 32 may have a vent hole 38 for facilitating the exchange of air flow from outside of the crown 30 to inside of the crown 30. The crown 30 may also be formed as a singular unit, a cap, a smooth contour, a top with pleats, etc. Furthermore, the crown 30 may be shortened as in a headband visor, which will be discussed later in more detail.

Figure 3:
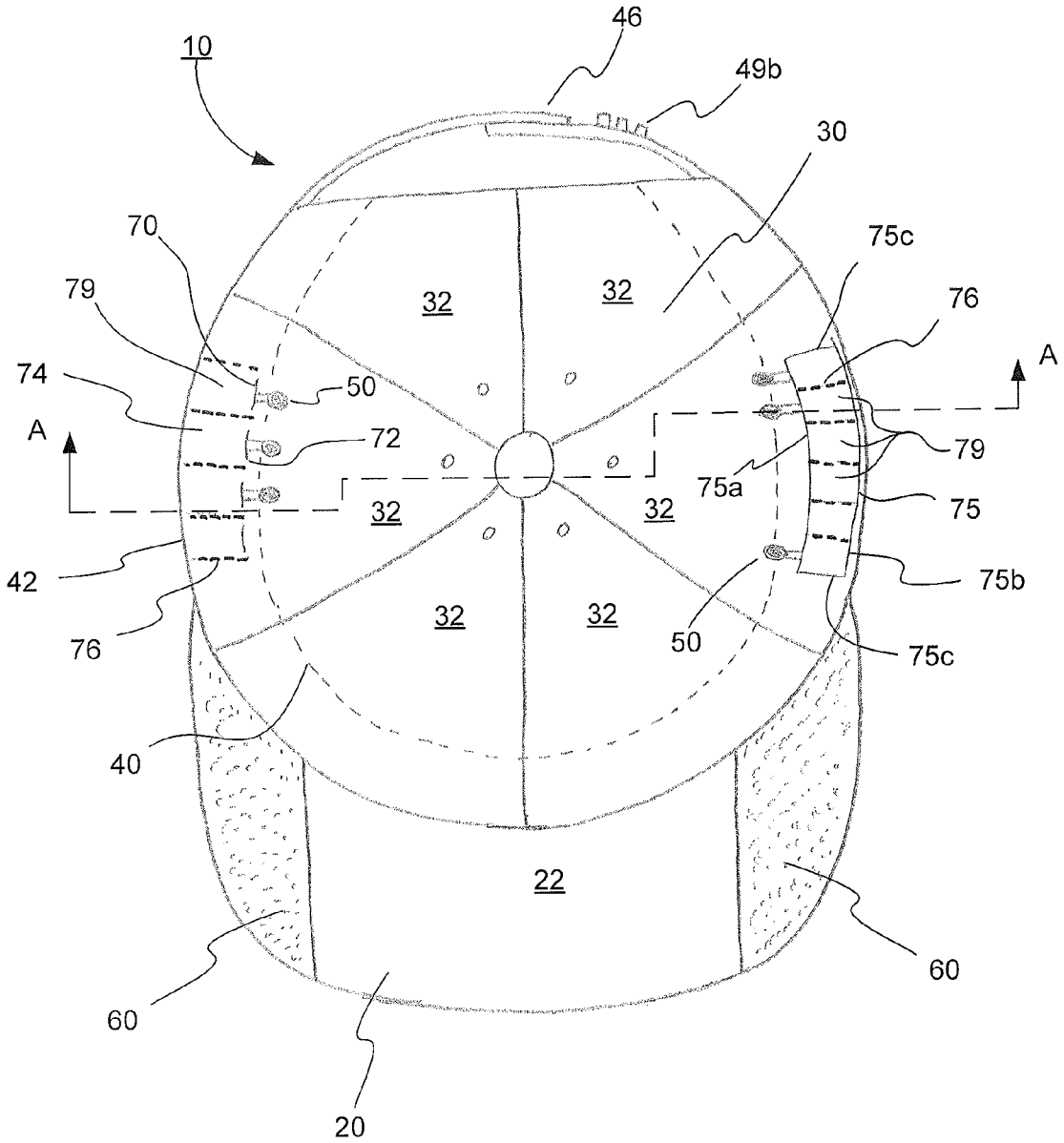
FIG. 3 shows a top view of the hat assembly.

FIG. 3 shows a top view of the hat assembly 10 showing the headband portion 40 having at least one slit or aperture 72 adapted to receive and secure a portion of a flammable instrument 50, such as a matchstick or other incendiary device. As shown, a majority of a lower end or bottom portion 52 of the flammable instrument 50 is slid into the aperture 72 and captivated in the headband portion 40 of the cap assembly 10. Alternatively, the flammable instrument 50 may be secured by an external pocket 75 disposed on the crown 30 of the hat assembly 10 as discussed in more detail below. The headband portion 40 may be constructed in the form of a continuous annular rim, or may have an adjusting mechanism 46 as also shown in FIGS. 4-5 in more detail.

Figure 4:
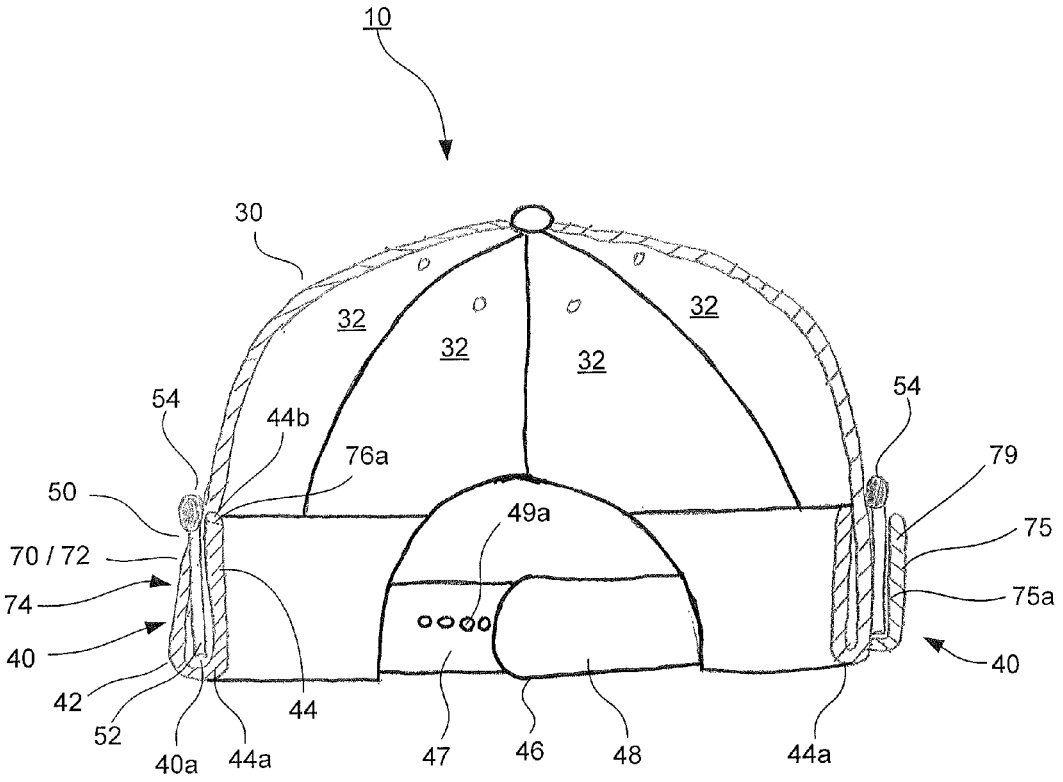
FIG. 4 illustrates a partial cross section view of the hat assembly about A-A in FIG. 3.
Figure 5:
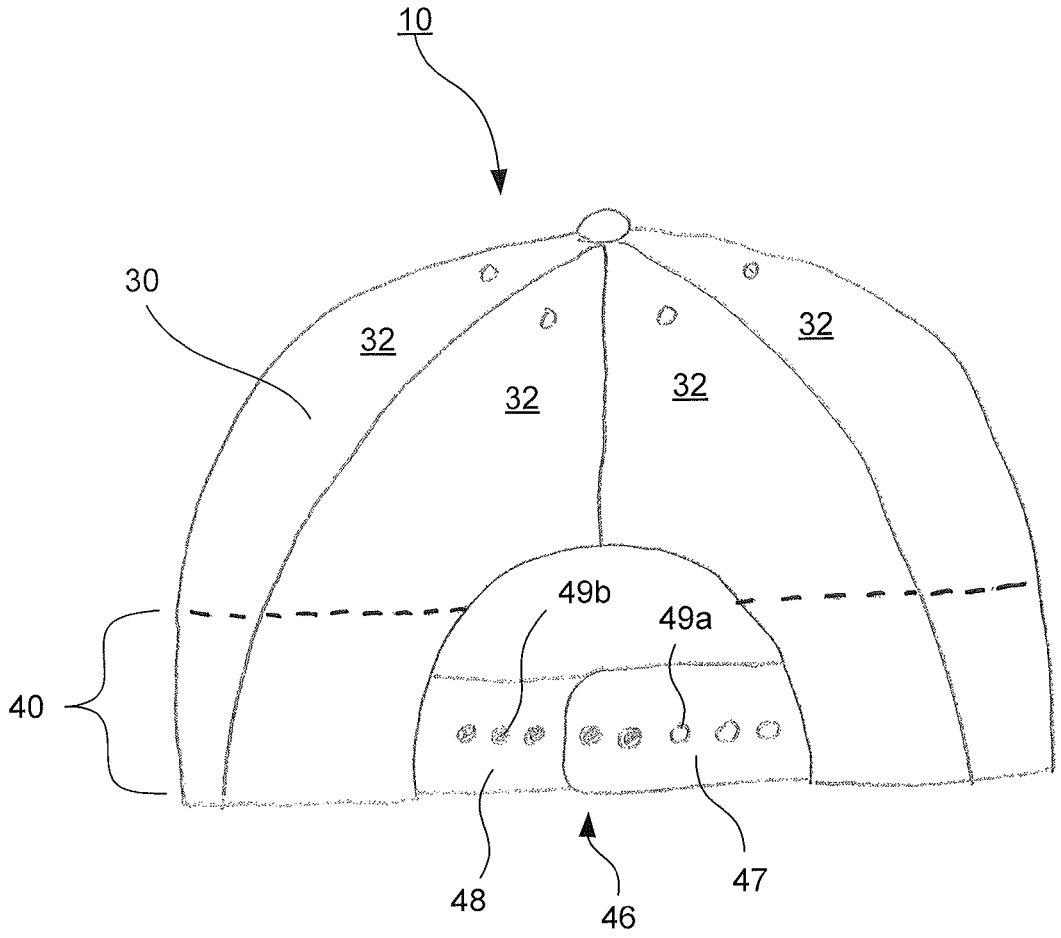
FIG. 5 shows a rear view of the hat assembly.

FIG. 4 illustrates the headband portion 40 in more detail about section lines A-A in FIG. 3, wherein the headband portion 40 is comprised of an inner fold 44. The upward turned inner fold 44 is attached to the lower edge 42 of the headband portion 40 via a lower end 44*a* or cupped end of the inner fold 44. An inner compartment 40*a* capable of holding a flammable instrument 50 is constructed in this manner. Various other inner compartment shapes are possible. For example, the inner fold 44 may be a concentric inward fold around a lower end of the crown 30. Alternatively, the fold 44 may be a smaller sub-section disposed in a similar location similar to the inner fold of FIG. 4 adapted to receive the various flammable instruments 50. Alternatively as also shown in FIGS. 3-4, an external pocket 75 may be constructed of one or more material strips and may be provided on the crown 30, or other location, to define various sub-pockets 79 into which one or more of the flammable instruments 50 may be securely received.

When the flammable instrument 50 is in a storage position, the flammable instrument 50 is positioned through the aperture 72 and into the inner compartment 40*a*. In the stored position, the bottom portion 52 (or alternatively, placed upside down, a reactive portion 54) of the instrument 50 is received by and held within the inner compartment 40*a* in place by the lower end 44*a* of the inner fold 44. The distance between the inner fold 44 material and the lower edge 42 of the material of the headband portion 40 may be constructed substantially narrow to provide a friction fit between the inner surface of the bottom portion 52 of the flammable instrument 50 and the inner surface of the material defining the inner fold 44. A headband pocket 74 enclosing the inner compartment 40*a* is formed by the lower edge 42, the inner fold 44, and the lower end 44*a*. Referring to FIG. 3, various stitching elements 76 may be sewn into the inner fold 44 or the external pocket 75 of the various sub-pockets 79 into which one or more flammable instruments 50 may be securely received.

Likewise, the upper end 44*b* of the inner fold 44 may be attached to an underside of the crown 30 to close and secure the inner compartment 40*a* of the headband pocket 74. The secure connection may be made by a stitching element 76*a*. The internal compartment 40*a* may be lined with the striking surface 60 so that when the flammable instruments 50 are pulled from a head first inserted storage position the flammable instrument 50 can be ignited when pulled out of the headband pocket 74.

An inner lining of the headband pocket 74 or the external pocket 75 may include the striking surface disposed thereon. Therefore, when the reactive portion 54 of the flammable instrument 50 is placed within the pockets 74, 75 with the reactive portion 54 head first, the user may then remove the flammable instrument 50 from the pocket 74, 75 and simultaneously ignite the instrument 50, as described in more detail below. Stitching elements 76, as shown in dashed line, may be sewn between a top portion of the inner fold 44 and the lower edge 42 (and/or at the upper end 44*b* of the inner fold 44 as shown by 76*a*) to provide added protection (from heat and loose flammable material) from striking the user's head when igniting the flammable instrument 50 on the striking surface 60.

In FIG. 5, the adjustment mechanism 46 has a receiving strap 47 having a plurality of apertures 49*a* and a protruding strap 48 having a plurality of protrusions 49*b*. The protrusions 49*b* are adjustably received by the apertures 49*a* and fix the relative position of the protruding strap 48 and receiving strap 47 at a predetermined length. Various alternatives may be embodied by a suitable adjustment mechanism. For example, the adjustment mechanism 46 may also be made employed with the use of VELCRO® buckles, and/or any other suitable adjustable fastening system. By varying the relative position of the receiving strap 47 and the protruding strap 48, the user can adjust a circumference of the headband portion 40 to comfortable fit securely on a user's head. The adjusting mechanism 46 may also be made of a continuous length of elastic material which conforms to the shape of the user's head and/or any other suitable adjusting mechanism.

Referring back to FIG. 4, the reactive portion 54 of flammable instrument 50 is typically a mixture of phosphorus sesquisulfide and potassium chlorate. When the reactive portion 54 is struck or rubbed against the rough surface of a striking surface 60, frictional heat causes the phosphorus sesquisulfide to ignite. The reactive portion 54 may include other alternatives, such as: antimony trisulfide, sulfur, powdered glass, inert fillers, a binder and/or any other suitable material to facilitate the ignition. The flammable instrument 50 may take a variety of forms, including but not limited to, a friction match, a safety match, etc. Alternatively, a lighter can be secured within a pocket constructed in the hat assembly 10.

In the case of safety matches, the reactive portion 54 may require the reactive phosphorus sesquisulfide for ignition. Here, the phosphorus may be located on the rough surface and may ignite the potassium chlorate in the reactive portion 54 upon frictional heat. The position of the various compositions may be interchanged.

Figure 6:
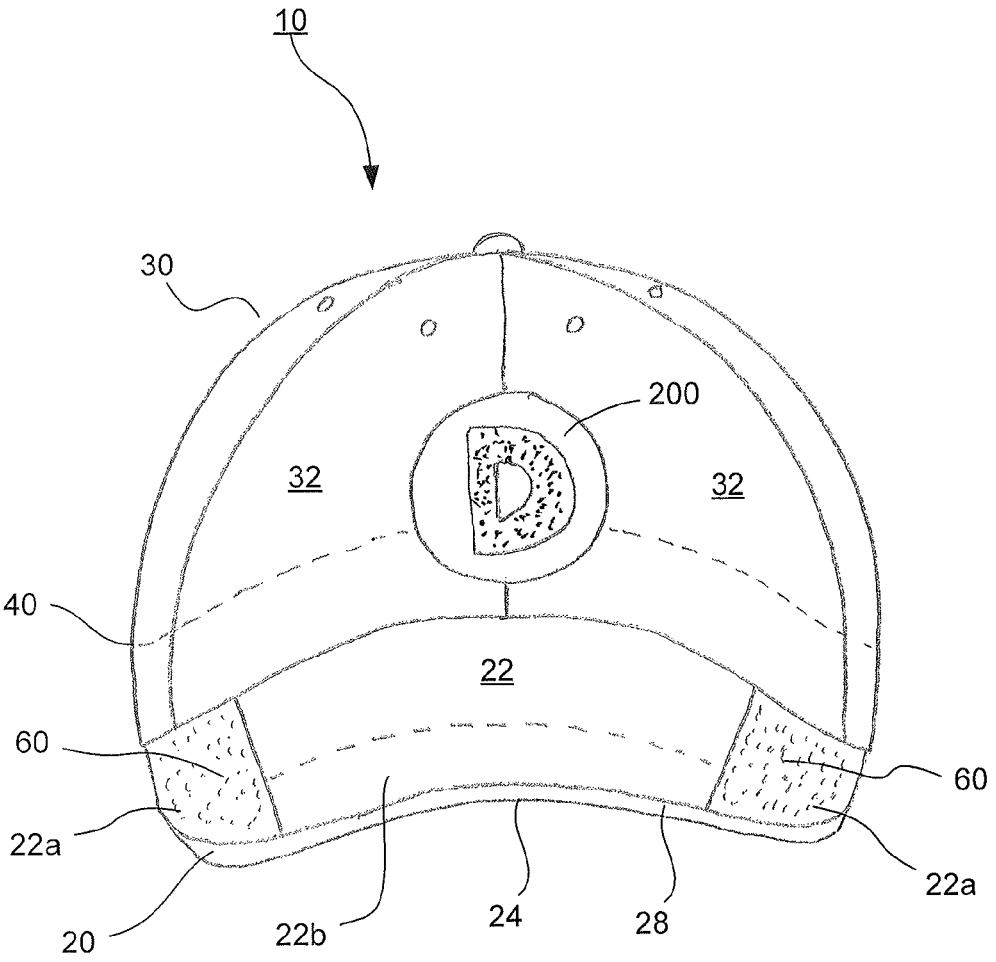
FIG. 6 shows a front view of the hat assembly.

FIG. 6 shows two striking surfaces 60 extending along lateral edges 22*a* on the top surface 22 of the brim 20. The striking surface 60 may be of any size and provided in any number of different orientations along the brim 20, such as along a transverse edge 22*b* on the top surface 22 as shown in dashed line. Having the striking surface 60 on the top surface 22 of the brim 20 provides the added protection from heat and loose flammable material from striking the user's head and face when igniting the flammable instrument 50 on the striking surface 60. Likewise, although the striking surface 60 is shown on the top surface 22, the subject disclosure encompasses any number of striking surfaces 60 in various locations, in a variety of configurations, on any surface of the brim 20, the crown 30, or the headband portion 40.

The material of the striking surface 60 can be made of any sufficiently rough material having a coefficient of friction to create frictional heat when struck by the reactive portion 54 to cause ignition of a flame. As mentioned previously, the striking surface 60 may also comprise phosphorous sesquisulfide, a metallic material, concrete and/or any other suitable rough composition to facilitate the ignition of the flammable instrument 50.

Figure 7:
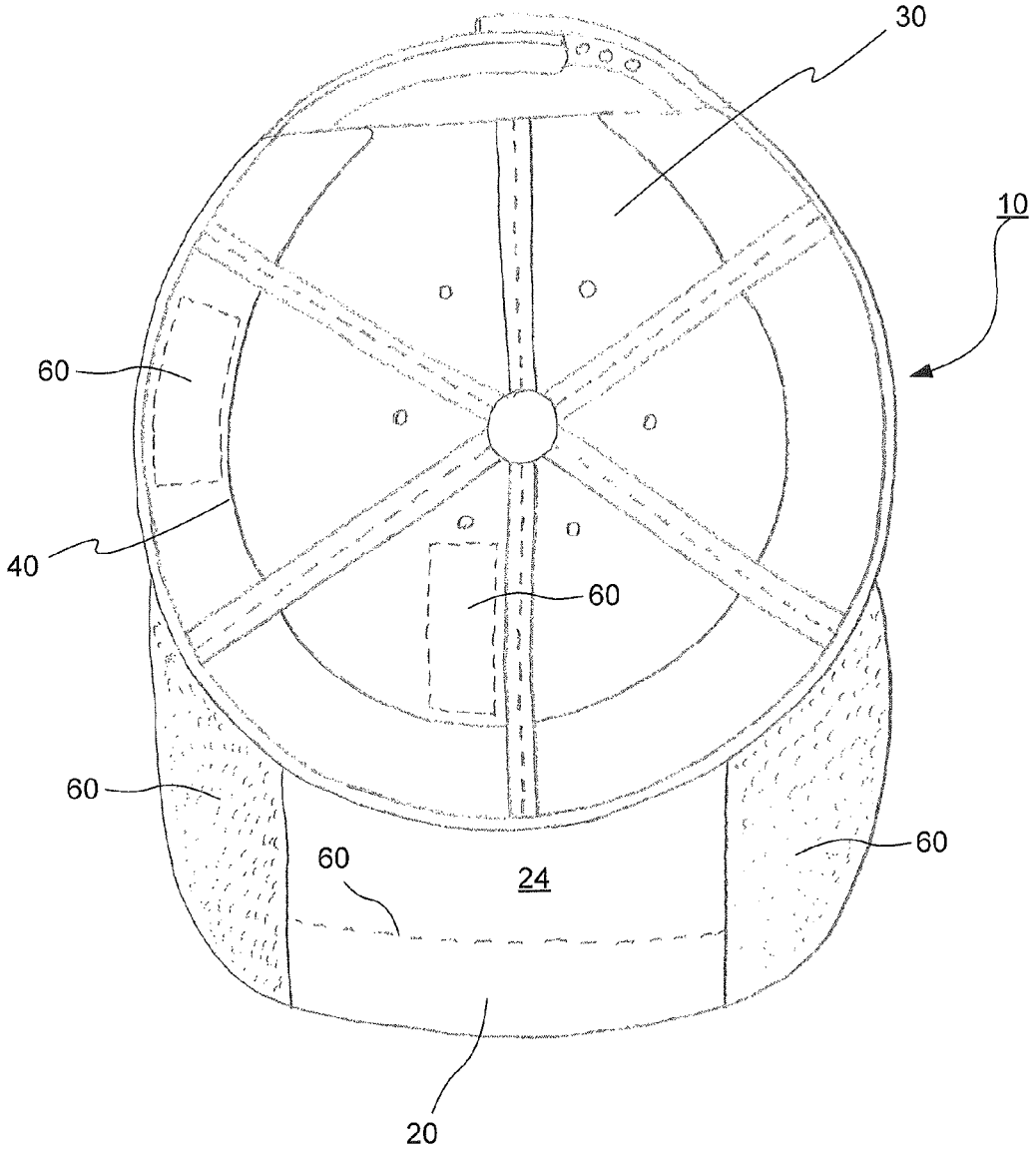
FIG. 7 illustrates another example of the hat assembly having the striking surface on a bottom surface of the brim.
Figure 8:
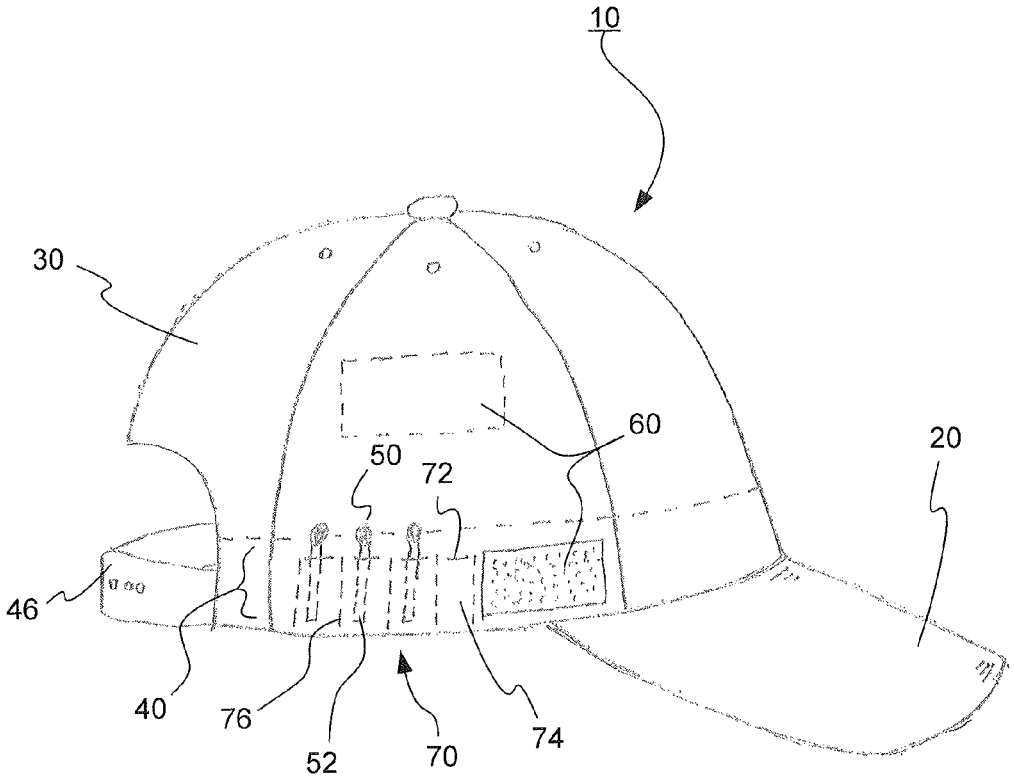
FIG. 8 illustrates another example of the hat assembly having the striking surface on the headband portion.

FIGS. 7-8 illustrate alternative embodiments of the hat assembly 10. In FIG. 7, the striking surface 60 is located on the bottom surface 24 of the brim 20. It is to be understood that the striking surface 60 may be provided at various other positions on the hat assembly 10, such as shown in dashed line on the crown 30 and on the headband portion 40.

By way of example, the rough striking surface 60 may be embodied as a logo 200 or other indicia provided anywhere on the hat assembly 10, such as shown in FIG. 6.

In FIG. 8, the striking surface 60 may be located on the headband portion 40. Locating the striking surface 60 at the headband portion 40 facilitates rigidity and encourages ample striking force as the headband portion 40 is much more taut and/or rigid due to the headband portion 40 being compressed against the user's head when the hat assembly 10 is worn. The striking surface 60 can also be located on any surface of the hat assembly 10. Each of these positions is easy to reach and provides a convenient location to strike and ignite the flammable instrument 50.

In use, the user can lift the flammable instrument 50 out from the headband pocket 74 thru the aperture 72 by grabbing an exposed portion of the flammable instrument 50. Similarly, when storing a flammable instrument 50 within the receptacle 70, the user will push the bottom portion 52 of the flammable instrument 50 thru the aperture 72 and into the headband pocket 74. This process can conveniently be performed with a single hand as described in more detail later. Likewise, this storage and retrieval process can be done with or without the hat assembly 10 being placed on the user's head.

Referring back to FIG. 3, alternatively the receptacle 70 may be in the form of the external pocket 75. In one construction, the external pocket 75 may have a first open edge 75*a*, a closed edge 75*b*, and closed side edges 75*c*. Alternatively, the closed edge 75*b* may be open. When the flammable instrument 50 is stored, the bottom portion 52 of the instrument 50 is received by and held in place by the external pocket 75. The distance between an inner surface of an outer panel 75*a* of the external pocket 75 and an adjacent facing inner surface of a panel 32 or headband portion 40 (against which the external pocket 75 lies) may be substantially narrow to provide a friction fit between the bottom portion 52 of the flammable instrument 50 and the outer panel 75*a* material defining the external pocket 75. Moreover, the external pocket 75 may also be placed on an inner surface of the headband portion 40 adjacent to the head of the user when worn, in place of the externally provided pocket 74.

Figure 9:
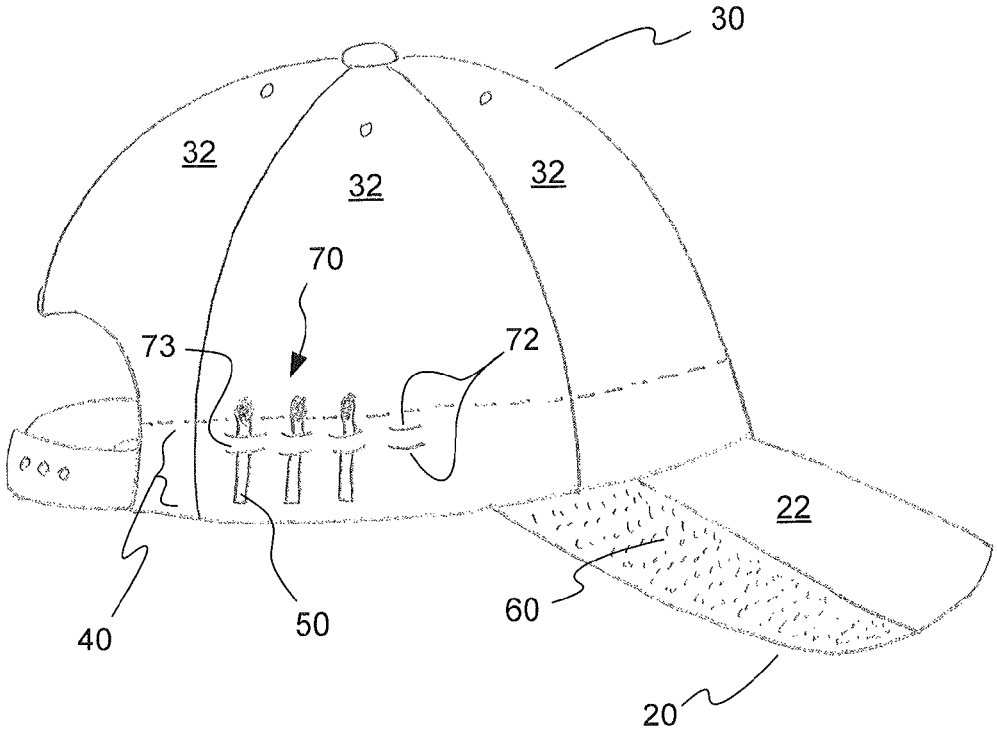
FIG. 9 shows another example of the receptacle comprised of a band.

FIG. 9 shows an alternative embodiment in which the receptacle 70 that receives the flammable instrument 50 is composed of a band 73 formed by two parallel apertures 72 disposed in at least one panel 32. As shown here, a portion of the flammable instrument 50 is held by the band 73. The band 73 can also be formed separately from the panel 32 as well. The band 73 can be located at any point along the crown 30 or headband portion 40 and/or at various angles with respect to the headband portion 40.

Figure 10:
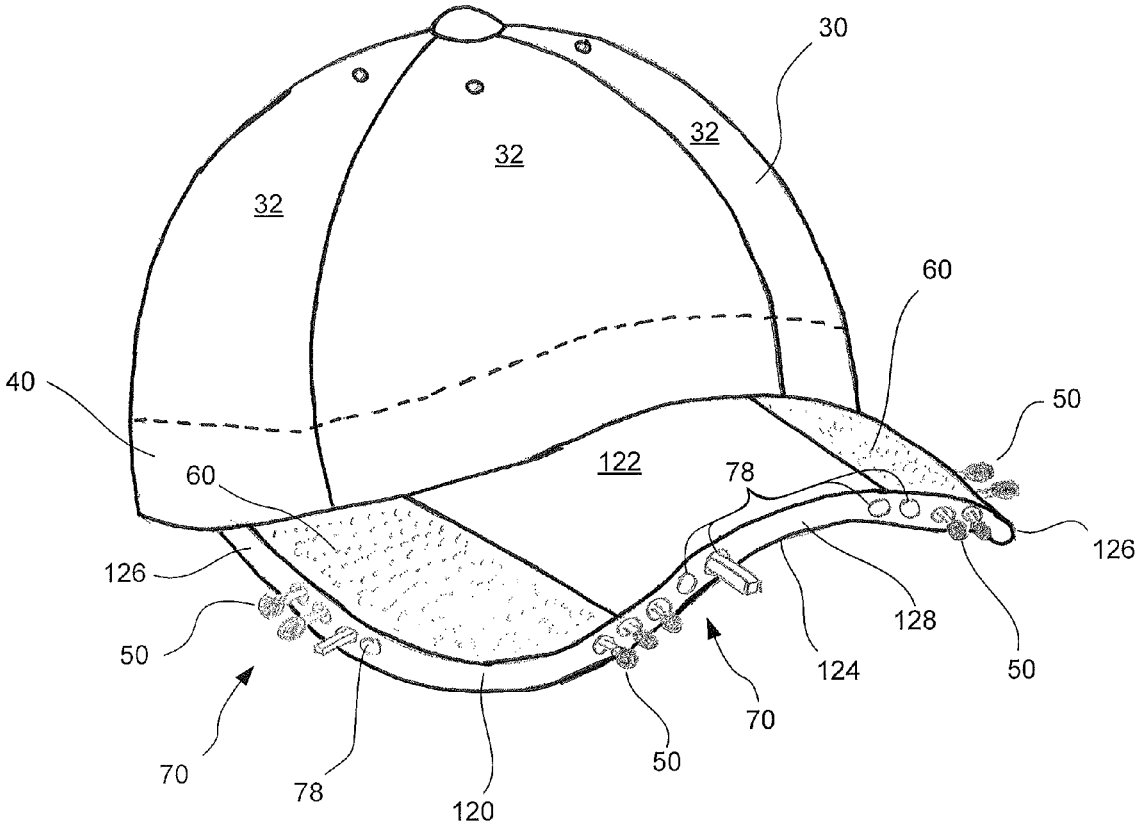
FIG. 10 shows an alternative example of the hat assembly having receptacles located within the brim.
Figure 11:
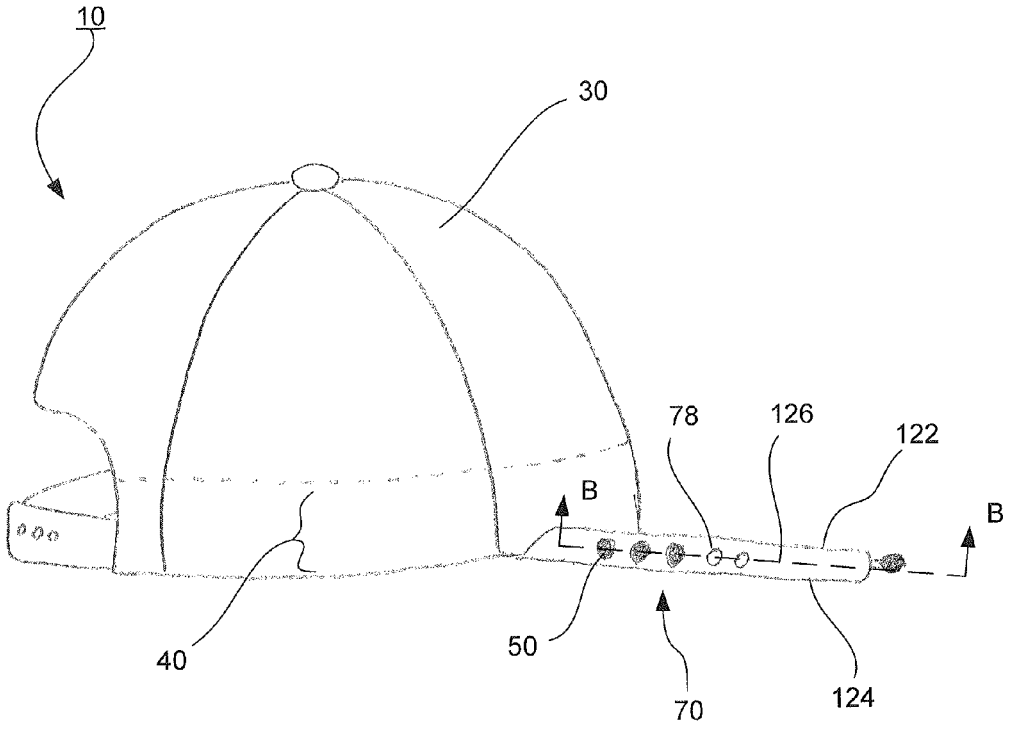
FIG. 11 shows a side view of the hat assembly depicting the receptacle located within the brim.
Figure 12:
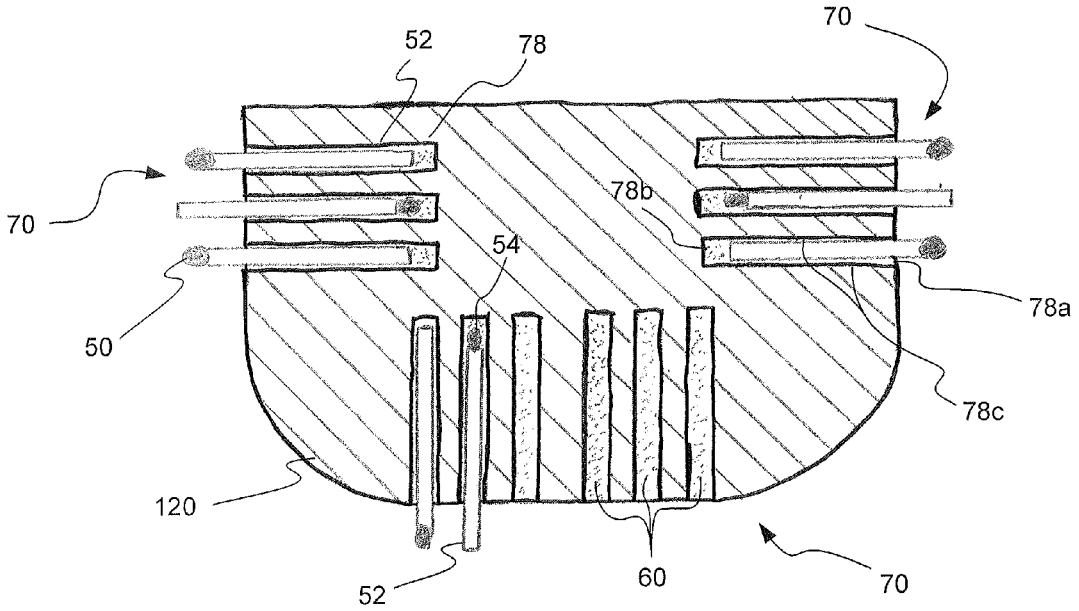
FIG. 12 illustrates a partial cross section view of the hat assembly about B-B in FIG. 11.

FIGS. 10-11 show another embodiment in which receptacles 70 are defined within a brim 120 to receive the various flammable instruments 50. The receptacles 70 includes a plurality of apertures or slots 78 defined within side surfaces 126 and/or front surface 128 of the brim 120. The slots 78 can be constructed in a variety of shapes that recess into the brim 120 between a top surface 122 and a bottom surface 124. As described later, the flammable instruments 50 may be conveniently located head first with the bottom portion 52 of the flammable instrument 50 inward (as also shown in FIG. 12), or disposed outward. The brim 120 can take a variety of different shapes, such as in the form of a complete annular rim, band, fringe, ridge, frame or other suitable configuration.

FIG. 12 illustrates a cross-section of the brim 120 showing the receptacle 70 about section lines B-B in FIG. 11. The various slots 78 are shown defined within the brim 120. Each slot 78 includes an open end 78*a*, a closed end 78*b*, and elongated side walls 78*c*. As shown, a majority of the lower end of the flammable instrument 50 is slid into the slot 78 and captivated within the brim 120 of the hat assembly 10 through a slip-fit grip. As mentioned previously and also shown in the alternative, an upper portion 54 of the flammable instrument 50 may be secured head first into the slot 78.

Figure 13:
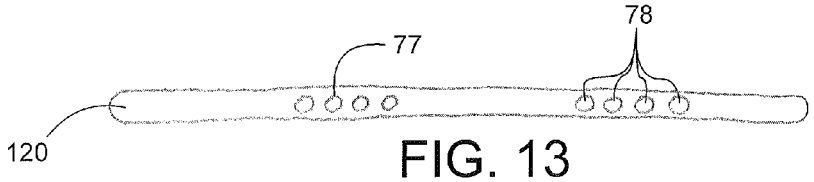
FIG. 13 depicts an example configuration for a side surface of the brim having a receptacle.
Figure 14:
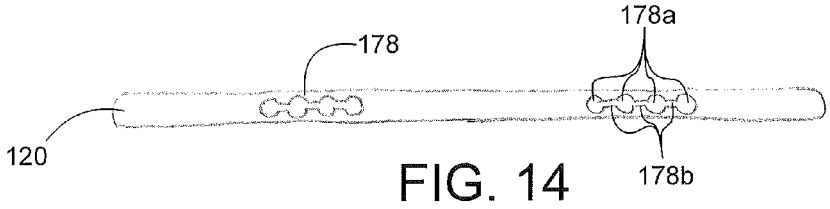
FIG. 14 depicts another example configuration for a side surface of the brim having a receptacle.
Figure 15:
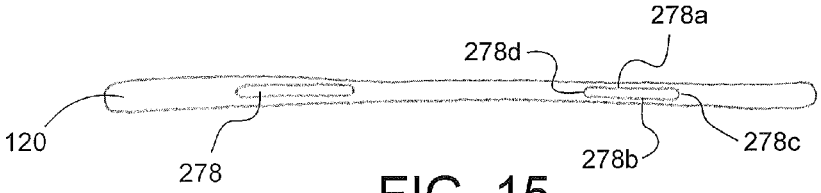
FIG. 15 depicts yet another example configuration for a side surface of the brim having a receptacle.

FIGS. 13-15 shows front or outward views of the brim 120 having different embodiments for the slots 78. FIG. 13 depicts the slot 78 as a plurality of discreet cylindrical recess having a circular open end 77. FIG. 14 shows an alternative embodiment of a connected slot 178 including cylindrical recesses 178*a* laterally connected by flat or rectangular recesses 178*b*. A height of the rectangular recess 178*b* is less than a diameter of the cylindrical recess 178*a*. FIG. 15 depicts yet another alternative embodiment of an elongated slot 278 constructed of a top wall 278*a*, an equidistant bottom wall 278*b*, a first side wall 278*c* and a second side wall 278*d*. The slots 78, 178, 278 secure the flammable instrument 50 by way of a slip-fit grip between a portion of the flammable instrument 50 and the respective walls such as the inner wall 78, 178*a*, top wall 278*a* and bottom wall 278*b*.

Figure 16:
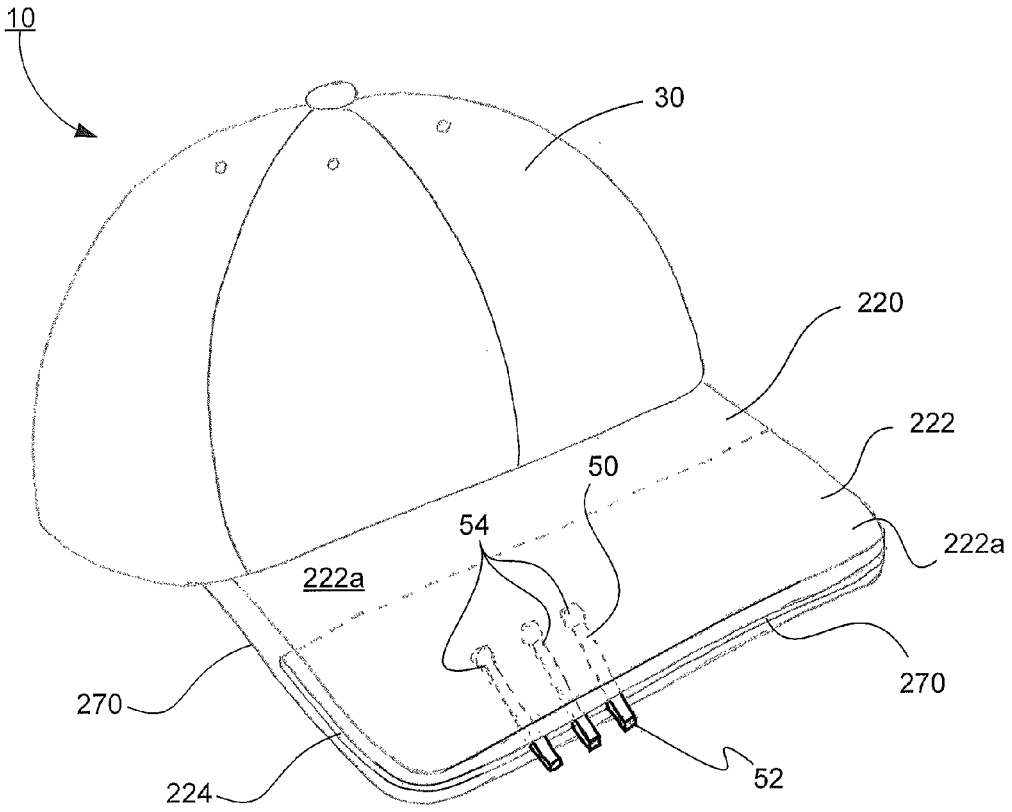
FIG. 16 illustrates another example of the hat assembly comprised of a brim having a sandwich flap design to secure and ignite the flammable instrument therein, when the flap is in a closed position.
Figure 17:
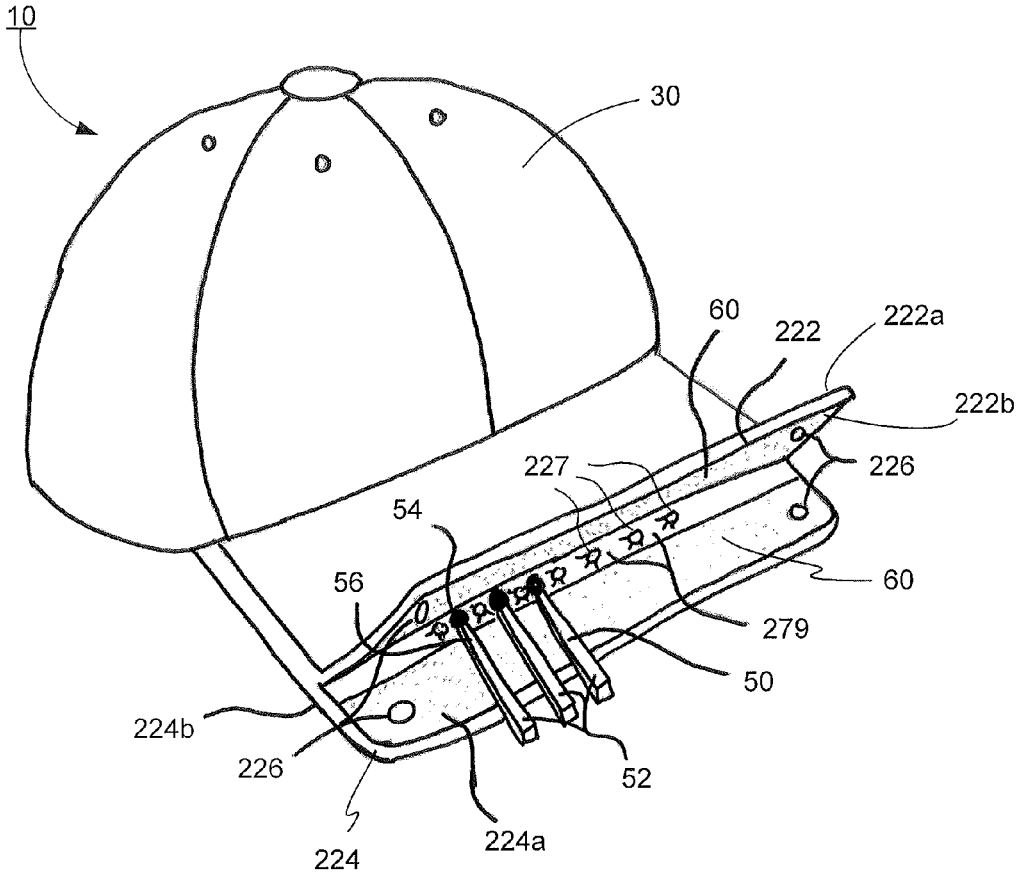
FIG. 17 illustrates the flap in an open position having a striking surface and a brim fastener.

FIGS. 16-17 show an alternative embodiment for a receptacle 270 in which the hat assembly 10 is composed of a split brim 220 having an upper front panel 222 and lower front panel 224. The upper front panel 222 includes a top surface 222*a* and a bottom surface 222*b*. The lower front panel 224 includes a top surface 224*a* and a bottom surface 224*b*. The bottom surface 222*b* of the upper front panel 222 comes in contact with the top surface 224*a* of the lower front panel 224 and form a receptacle 270.

FIG. 16 shows the receptacle 270 in a closed position. As shown in dashed line, a majority of an upper end 54 of the flammable instrument 50 is placed into the receptacle 270 and secured by a friction fit between the upper front panel 222, the lower front panel 224 and the upper end of the instrument 50. The upper front panel 222 may be in the form of a flap, pocket, cover, strip or other suitable configuration which would provide the friction fit grip of the flammable instrument 50 between the upper front panel 222 and lower front panel 224.

FIG. 17 shows the receptacle 270 in an open position. The striking surface 60 may be located on either the bottom surface 222*b* or top surface 224*a*, or both. The upper front panel 222 may be lifted to insert the flammable instrument 50 into the split brim 220. Index tabs 272 may be added to facilitate aligning and securing the flammable instrument 50 in place and to form separate discrete compartments 279 for receipt of each of the flammable instruments 50. Each separate compartment 279 would receive an upper portion 56 of the flammable instrument 50. In addition, the index tabs 272 may act as a barrier and hinder the ignition of one flammable instrument 50 from igniting another nearby instrument 50. The index tabs 272 may be made from a flame retardant material to block and further hinder the undesired ignition of adjacent flammable instruments 50.

Furthermore, the upper front panel 222 and lower front panel 224 are securely connected to each other by a brim fastener 226, which can be in the form of VELCRO®, snap-fit button, magnets, or any other affixing device or method. The brim fastener 226 may be provided along any area of the upper front panel 222 or lower front panel 224.

For the configuration shown in FIG. 16-17, the user may remove the flammable instrument 50 from the receptacle 270, while simultaneously igniting the instrument 50 by pulling on the bottom portion 52, thereby causing frictional heat to ignite the flammable instrument 50, as described in more detail below.

Figure 18:
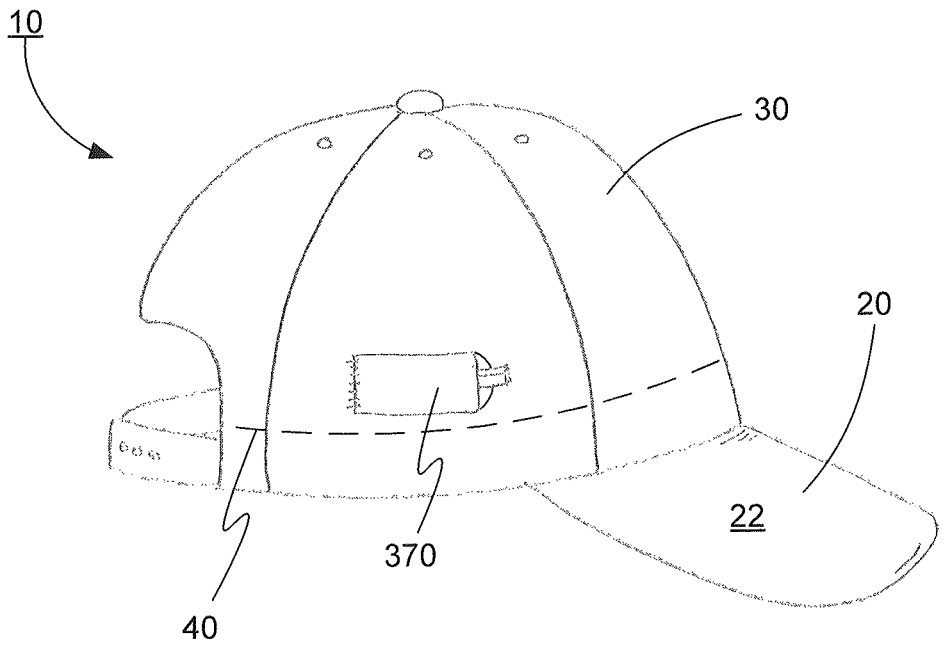
FIG. 18 shows another example configuration for a receptacle having a flap in a closed position.
Figure 19:
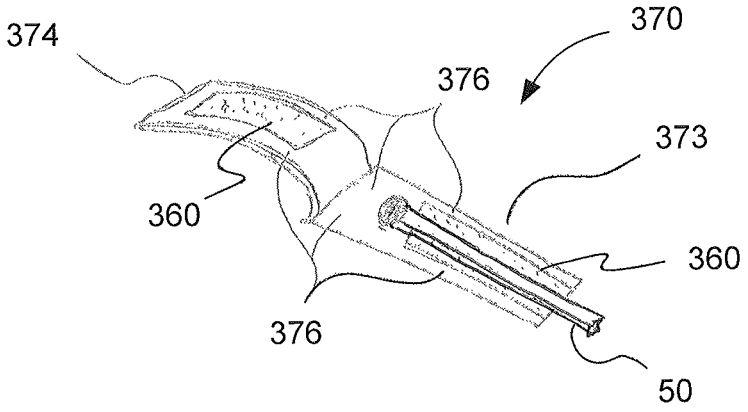
FIG. 19 shows the receptacle having the striking surface and the flap in an open position.

FIGS. 18-19 show another embodiment in which the hat assembly 10 includes a pocket flap receptacle 370 having an attachment layer 373 and a mating cover flap 374. The attachment layer 373 can be fastened to the brim 20, the crown 30, the headband portion 40, or any portion of the hat assembly 10 by a suitable attachment mechanism or method. The attachment layer 373 and the cover flap 374 may be fixed together by a flap fastener 376, which can be in the form of VELCRO®, an adhesive, a snap-fit fastener, magnets, or any other suitable fastening device and/or method for securing the cover flap 374 to the attachment layer 373 to cause a friction fit of the flammable instrument 50 within the pocket flap receptacle 370. The friction fit grip is provided between an inner surface of the flap 374 and an adjacent surface of the attachment layer 373 which secures and holds the flammable instrument 50 in a storage position. The receptacle 370 may also include a striking surface 360, which would facilitate the ignition of the flammable instrument 50 when the instrument 50 is pulled out of the storage position. The receptacle 370 may be located on any surface of the hat assembly 10, including but not limited to the top surface 22 or bottom surface 24 of the brim 20, the crown 30 or the headband portion 40.

Figure 20:
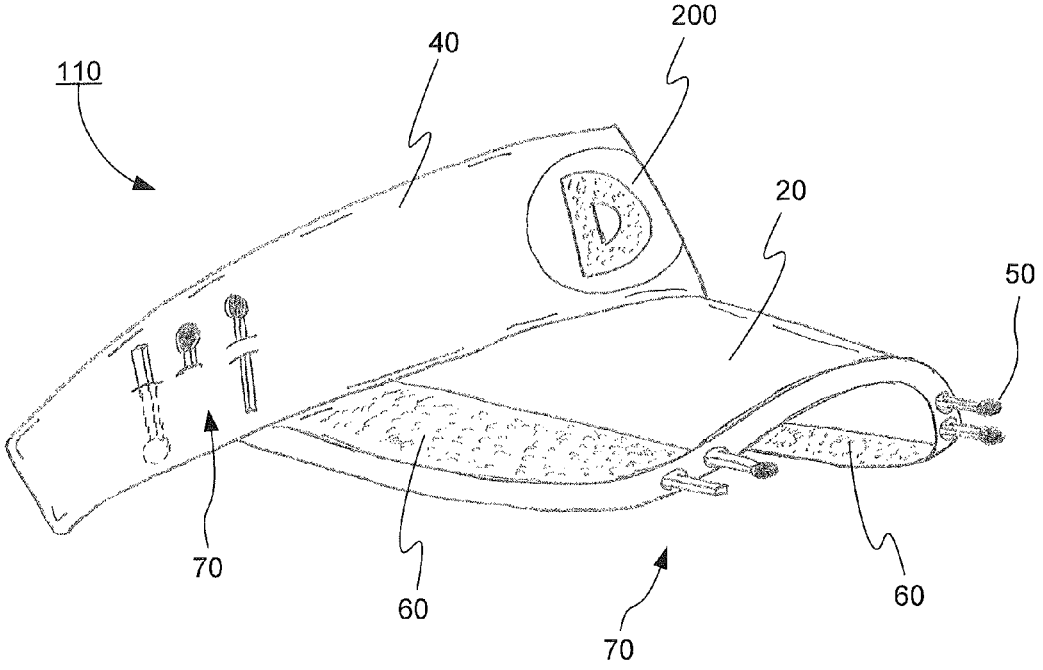
FIG. 20 illustrates an alternative example of a hat assembly in the form of a visor having a brim and headband portion.

FIG. 20 shows an alternative embodiment of a hat assembly 110 in the form of a visor, having a brim 20 and headband portion 40. Again, the striking surface 60 and the various receptacles 70, 170, 270, 370 may be located in or on any surface of the hat assembly 110 as described above with respect to the hat assembly 10.

FIGS. 21-24 illustrate methods by which the hat assembly 10 may ignite the flammable instrument 50. An advantage of the subject disclosure is the use of only a single hand to cause the final ignition of the flammable instrument 50, while conventional inefficient methods previously required the cumbersome use of two hands.

Figure 21:
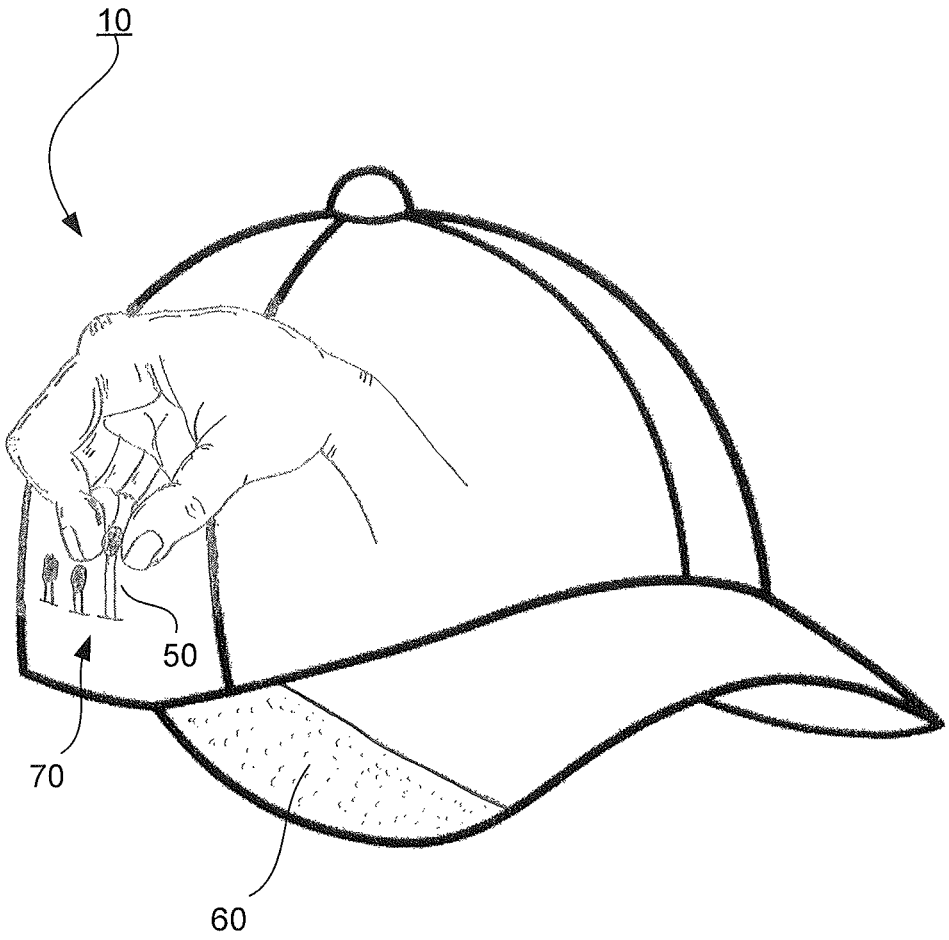
FIG. 21 depicts a two-step method of using the hat assembly for retrieving the flammable instrument from the receptacle.
Figure 22:
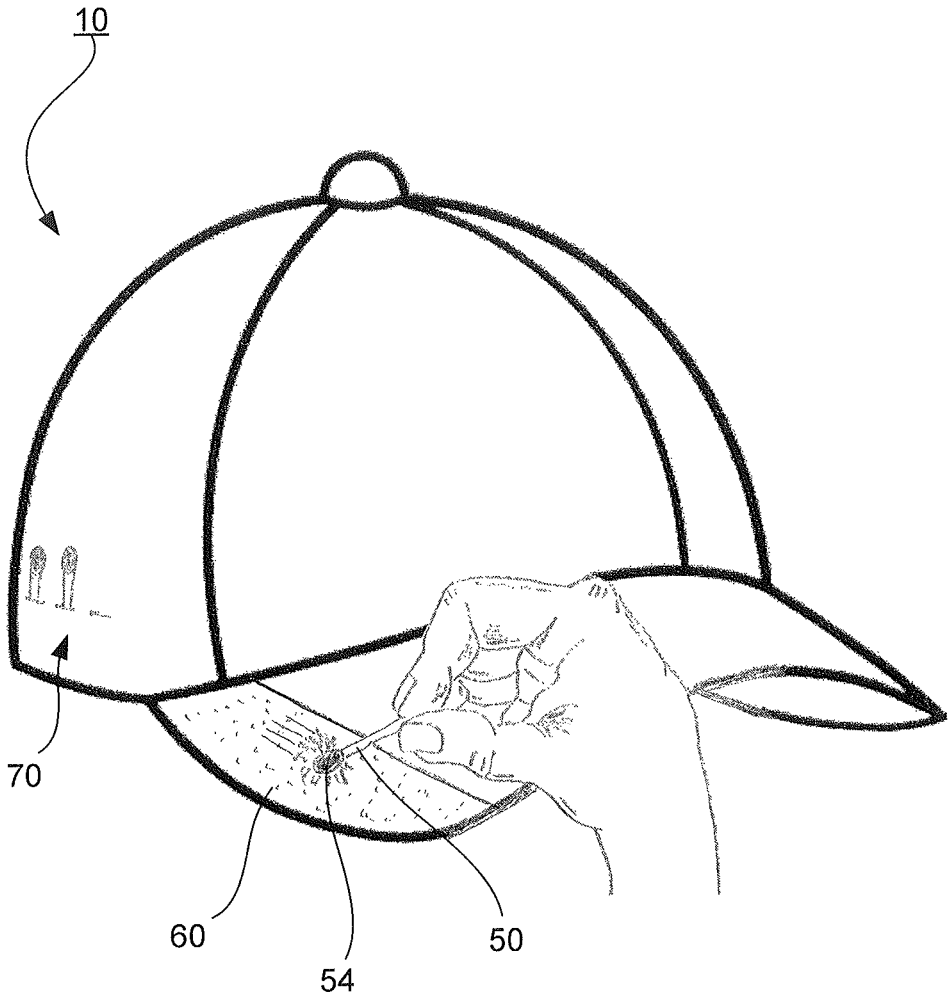
FIG. 22 depicts sliding the flammable instrument against the striking surface.
Figure 23:
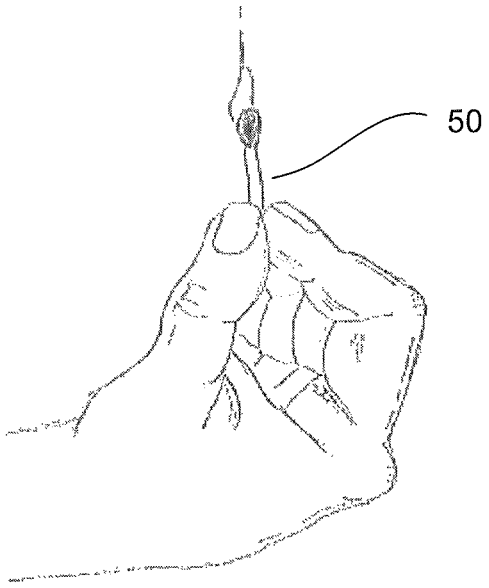
FIG. 23 depicts the final ignition of the flammable instrument.

FIGS. 21-23 depict a one-handed two-step process comprised of: 1) gripping a portion of the flammable instrument 50 and pulling it out from the storage receptacle 70; and in a second step 2) striking the flammable instrument 50 over the striking surface 60 (as shown in FIG. 22) to ignite the flammable instrument 50 as shown in FIG. 23. The receptacle 70 and striking surface 60 may be located on either side of the hat assembly 10, which allows both right handed and left handed users to easily and conveniently reach and ignite the flammable instrument 50.

Figure 24:
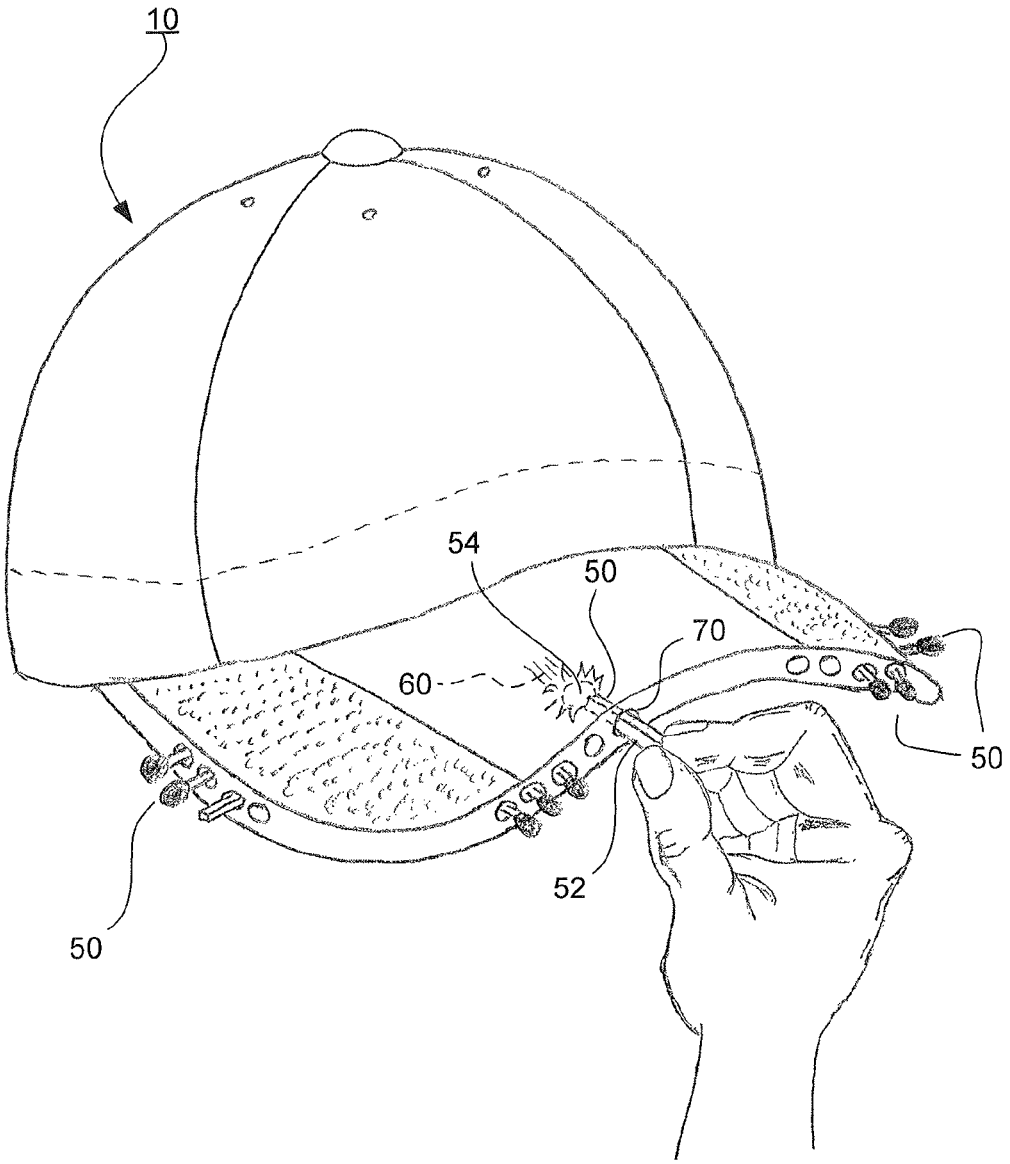
FIG. 24 depicts a one-step method for igniting the flammable instrument from the storage position of the flammable instrument with the hat assembly.

FIG. 24 depicts another advantageous process for igniting the flammable instrument 50. In this one-step process, the user grips and pulls the bottom portion 52 of the flammable instrument 50. While the flammable instrument 50 is pulled out of and slides out of the receptacle 70, the reactive portion 54 slides against the striking surface 60 within receptacle 70 to ignite the flammable instrument 50. The frictional heat generated by the relative motion between the striking surface 60 and reactive portion 54 causes the ignition of the flammable instrument 50.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples of a hat assembly and method of use that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A hat assembly comprising:
a headband portion;
a brim connected to the headband portion, the brim having a top surface and a bottom surface; and
at least one striking surface comprises: phosphorous sesquisulfide; a metallic material; and concrete integrated into the hat assembly to ignite a flammable instrument, wherein the striking surface is disposed on at least one of the following:
the top surface of the brim;
the bottom surface of the brim;
any lateral extending edge on the top surface of the brim;
such that the striking surface is adapted to be used to ignite the flammable instrument while the hat assembly remains secured on a user's head.

2. The hat assembly as recited in claim 1, wherein the striking surface is made of a rough material having a coefficient of friction to create frictional heat when struck by a reactive portion of the flammable instrument to ignite the reactive portion.

3. The hat assembly as recited in claim 1, further comprising a receptacle having at least one aperture adapted to receive and secure a portion of the flammable instrument.

4. The hat assembly as recited in claim 3, wherein a lower end of the flammable instrument is slid into the aperture and secured via a friction fit within an internal compartment defined within the headband portion, wherein the internal compartment comprises:

a lower edge of the headband end extending to form a lower cupping end, which in turn extends upward into an inner fold.

5. The hat assembly as recited in claim 4, further comprising stitching elements sewn through the headband portion into the inner fold, or an external pocket, to define various sub-pockets into which one or more flammable instruments may be securely received.

6. The hat assembly as recited in claim 3, wherein the receptacle is an external pocket having an outer panel connected to an inner panel, wherein the external pocket comprises:

an open upper edge;

a closed lower edge; and closed side edges.

7. The hat assembly as recited in claim 6, wherein a distance between an inner surface of the outer panel of the external pocket and an adjacent facing inner surface of the inner panel is narrow and tight, providing a friction fit between the flammable instrument and the respective inner surfaces defining the external pocket.

8. The hat assembly as recited in claim 3, wherein the receptacle is comprised of a band which secures a portion of the flammable instrument.

9. The hat assembly as recited in claim 3, wherein the receptacle comprises at least one slot having an open end, and a closed inner end defined within the brim, such that the flammable instrument is slid into the slot and secured in the brim via a slip-fit grip.

10. The hat assembly as recited in claim 3, wherein the brim is a split brim comprising:

an upper panel having a top surface and a bottom surface;

a lower panel having a top surface and a bottom surface; and a brim fastener releasably fastening the upper panel to the lower panel, wherein when the bottom surface of the upper panel is secured against the top surface of the lower panel, the receptacle is formed to securely receive and secure the flammable instrument via a friction fit grip.

11. The hat assembly as recited in claim 3, wherein the striking surface is disposed within the walls of the receptacle to facilitate the ignition of the flammable instrument when the flammable instrument is removed from a stored position.

12. A hat assembly comprising:

a crown having a lower headband portion;

the brim connected to the crown, the brim having a top surface and a bottom surface;

a striking surface comprises: phosphorous sesquisulfide; a metallic material; and concrete integrated into the hat assembly to ignite a flammable instrument, wherein the striking surface is disposed on at least one of the following:

the top surface of the brim;

the bottom surface of the brim;

any lateral extending edge on the top surface of the brim; and a receptacle having at least one opening adapted to secure a portion at least one flammable instrument, wherein a piece of material that forms the lower headband portion extends down to form a lower cupping end, which then further extends upward to form an inner fold as the piece of material folds onto itself, creating an inner compartment out of a single contiguous piece of material into which the at least one opening leads;

wherein the striking surface is adapted to be used to ignite the flammable instrument while the hat assembly remains secured on a user's head.

13. The hat assembly as recited in claim 12, further comprising stitching elements sewn through the headband portion into the inner fold, or an external pocket, to define various sub-pockets into which one or more flammable instruments may be securely received.

14. The hat assembly as recited in claim 12, wherein the receptacle is an external pocket having an outer panel connected to an inner panel, wherein the external pocket comprises:

an open upper edge;

a closed lower edge; and closed side edges, wherein a distance between an inner surface of an outer panel of the external pocket and an adjacent facing inner surface of an inner panel is narrow and tight to provide a friction fit between the flammable instrument and the respective inner surfaces defining the external pocket.

15. The hat assembly as recited in claim 12, wherein the receptacle is comprised of a flap which provides a friction fit grip between an inner surface of the flap and an adjacent surface securely attached thereto which secures and holds one or more flammable instruments.

16. The hat assembly as recited in claim 12, wherein the receptacle comprises at least one slot having an open end, and a closed inner end defined within the brim, such that a lower end of the flammable instrument is slid into the slot and secured in the brim via a slip-fit grip.

17. A hat assembly comprising:

a crown having a lower headband portion;

a brim connected to the crown, the brim having a top surface and a bottom surface;

a receptacle having at least one opening within the headband portion adapted to secure a portion of one or more flammable instruments; and a striking surface comprises: phosphorous sesquisulfide; a metallic material; and concrete integrated into the hat assembly to ignite a flammable instrument, wherein the striking surface is disposed on at least one of the following:

the top surface of the brim;

the bottom surface of the brim;

any lateral extending edge on the top surface of the brim; and provided in at least one opening in the receptacle to ignite flammable instrument;

wherein the striking surface is adapted to be used to ignite the flammable instrument while the hat assembly remains secured on a user's head.

* * * * *